United States Patent [19]

Wagner

[11] 4,159,560

[45] Jul. 3, 1979

[54] EQUIPMENT FOR EXTRUSION IN PARTICULAR FOR THE EXTRUSION OF ALUMINUM BILLETS INTO SECTIONS AND THE LIKE

[75] Inventor: Alfred Wagner, Steisslingen, Fed. Rep. of Germany

[73] Assignee: Swiss Aluminium Ltd., Chippis, Switzerland

[21] Appl. No.: 732,955

[22] Filed: Oct. 15, 1976

[30] Foreign Application Priority Data

Oct. 21, 1975 [DE] Fed. Rep. of Germany ..... 2547067

[51] Int. Cl.[2] ..... B21C 23/21; B21C 33/00; B21C 35/04

[52] U.S. Cl. ..... 29/33 C; 72/272

[58] Field of Search ..... 29/33 C, 403, 327.6; 72/272, 270, 263, 257, 256, 354; 207/15, 16

[56] References Cited

U.S. PATENT DOCUMENTS

| | | | |
|---|---|---|---|
| 140,567 | 7/1873 | York | 72/272 |
| 900,401 | 10/1908 | Loomis | 72/272 |
| 2,371,041 | 3/1945 | Flowers | 72/354 |
| 2,860,775 | 11/1958 | Brauchler | 72/272 |
| 2,863,557 | 12/1958 | Munker | 207/16 X |
| 3,018,885 | 1/1962 | Trautman | 72/256 X |
| 3,083,827 | 4/1963 | Rosenthal | 72/263 |
| 3,150,773 | 9/1964 | Richter | 72/256 X |
| 3,698,227 | 9/1970 | Allen | 72/272 |

FOREIGN PATENT DOCUMENTS

| | | | |
|---|---|---|---|
| 701817 | 1/1965 | Canada | 72/270 |
| 252434 | 1/1911 | Fed. Rep. of Germany | 72/272 |

*Primary Examiner*—Horace M. Culver
*Attorney, Agent, or Firm*—Bachman & LaPointe

[57] ABSTRACT

Extrusion equipment for the shaping of billets, in particular billets of aluminum and its alloys, is described in which there is provided a split container through which an extrusion press ram passes. A casting unit adjacent to the press casts billets in series, and extrusion can be carried out utilizing heat retained in the billet from casting.

14 Claims, 6 Drawing Figures

EQUIPMENT FOR EXTRUSION IN PARTICULAR FOR THE EXTRUSION OF ALUMINUM BILLETS INTO SECTIONS AND THE LIKE

BACKGROUND OF THE INVENTION

The invention relates to extrusion equipment, in particular for the extrusion of aluminium billets into sections or similar items, in which equipment there is provided a container having a passage defined therein, and a press ram which passes through that passage.

In equipment of this type the billet which is to be extruded is normally introduced axially into the extrusion passage, and is deformed either in the stationary container by a moving press ram or pushed against a stationary press ram while contained in a movable container.

In both arrangements it has been found to be a disadvantage to be dependent on the relatively long loading times required by the mode of loading the container, and by the length of stroke of traverse of the container or press ram which is in turn dependent on the length of the billet. Because of the time required for the loading process, the billets are normally reheated prior to extrusion, in order to avoid a qualitative lowering of the resultant extrustion product as regards both mechanical properties and anodising quality.

SUMMARY OF THE INVENTION

It is therefore an object of the present invention to develop a machine of the kind initially described which has a short loading stroke and inter alia permits the billet to be extruded utilising the heat retained in the billet from casting.

This objective is met by the equipment including a split container and at least one feeding device positioned at the side or sides thereof for loading the billets to be extruded the billets being arranged approximately parallel to the container axis. In a container of such a design the press ram need only have a stroke corresponding to the length of the inserted billet; such a short stroke is not possible whith any extrusion machine or equipment available on the market today.

In accordance with another feature of the present invention, there are arranged upstream and adjacent to the feeding device a number of molds the molds being disposed downstream of a casting furnace and connected by a conveyor system to a waste or baling press of a separating station, for example a saw situated downstream of the container. Melting of the metal takes place in the furnace unit disposed immediately next to the container and its associated equipment.

It has been found advantageous if the machine includes a heating chamber for the billets disposed upstream of the feeding means to maintain the temperature of the billets at a predetermined level.

Because of the exceptionally fast extrusion sequence which can be achieved with the equipment, according to the present invention, it has been found particularly favorable to mechanise the plurality of molds themselves in such a way that two moving conveyor belts which move approximately synchronously and in contact with each other, form the molds together; the conveyor belts are fitted with groove shaped mold parts, disposed transverse to the direction of movement. It has been found acceptable to adjust the spacing between neighbouring belts thus forming connecting pieces between the cast billets. Due to these measures billets can be cast continuously and can be joined together by connecting pieces, so as to obtain sets of extrusion billets.

Alternatively lateral gripping arms can be used which grasp a plurality of billets simultaneously and transfer them to the container.

Extruded components from several billets can be employed in a split container, in accordance with the present invention, which container has a plurality of extrusion passages, and includes a plurality of aligned press rams which can be operated and controlled individually.

The split container having one or a plurality of passages includes at least a lower part and an upper part resting on the lower part and being hinged thereon; both parts of the container form in the open state thereof, in terms of the present invention, at least one entrance for the billets.

Loading takes place with the upper container part raised at the side facing away from the hinge axis.

This lateral loading of the container, in addition to permitting the already mentioned short stroke, also usefully permits release of air from the container passage; the air is displaced laterally from the container, without any air pockets remaining therein when the container is closed. In addition, lateral loading permits use of billets of almost the same diameter as that of the passage, so that even during loading, any air in the channel is almost completely displaced so that no problems associated with removal of air are encountered.

In accordance with another feature of the present invention, the upper part of the container is eccentrically hinged to its lower part, but approximately parallel thereto, so that both the upper and lower parts of the container are made to accept at least one facing piece which is movable together with one part of the container, and which also partly delineates the extrusion passage. Both parts of the container may be clad by fodder members, which form a liner when the container is closed.

The lower part of the container is preferably supported on a stand of the press, or on another fixed, stationary part of the equipment; the upper part of the container can be pressed on to its lower part by means of a closing device. A hinged or pivotable bell crank on the upper part is a preferred means for effecting this closure and not only guides and moves the upper part, but holds it adequately in place when it is open. Instead of this mechanical action, closure can also be effected by means of a hydraulic cylinder hingeably or pivotably attached to the upper part.

As support for, or in place of the bell crank, there can be provided, between the press stand or stands and the upper part of the container, a wedge which can be set on a bar provided on the container. This wedge is preferably introduced between the bar and a beam-like rail provided above the upper container part, thus clamping the upper part in place. In terms of the present invention this rail serves as a stop for the movable upper part. The upper part advantageously includes a support element which projects radially from the container entry region, so that the wedge may be inserted between the support element and the press stand, the press stand acting as support means.

In a further development of the invention, in addition to using the two-part container and lateral loading, it is proposed to use a container with at least two extrusion passages which are disposed on either side of a rotational axis, the upper and lower parts of the container being at least partly separable from each other by hinge means. It is also within the scope of the present invention to provide more than two passages for continuously loading the container. It is additionally advantageous if a bearing is provided so that the container may slid therethrough in an axial direction.

In accordance with another feature of the present invention, there is provided in the container a space for intensive cooling, by means of example for nitrogen, in which space the shaped section may be cooled, prior to being stretched, to a temperature at which stretching can still be performed. The stretching unit should preferably be situated in the immediate vicinity of the discharge end of the conveyor, in order that the section may be transported by means of an end guidance device, and may be inserted into the grips of the stretching unit. On placing the stretching unit immediately adjacent to the discharge track of the extrusion press the grips of the stretching unit are made to move in a direction transverse to the discharge direction; the stretching can then take place automatically when a disconnect switch for stopping the lateral movement of the grips is built into the system.

Any waste pieces, or chips, which result from sawing the section, or from other deformation- or cutting-operations can, in the case of a split container operating in conjunction with a baling press, be fed immediately thereinto and extruded; introducing cold scrap into axial loading containers, on the other hand, has been found to be difficult. From this it can be seen that the split container of the present invention is not only suitable for shaping billets, which are hot due to having been newly cast, but may also be beneficially utilized in other extrusion processes.

BRIEF DESCRIPTION OF THE DRAWING

Further advantages, features and details of the present invention will now be explained in the following description of preferred embodiments and with the help of drawings where.

DESCRIPTION OF THE PREFERRED EMBODIMENTS

Figure 1:
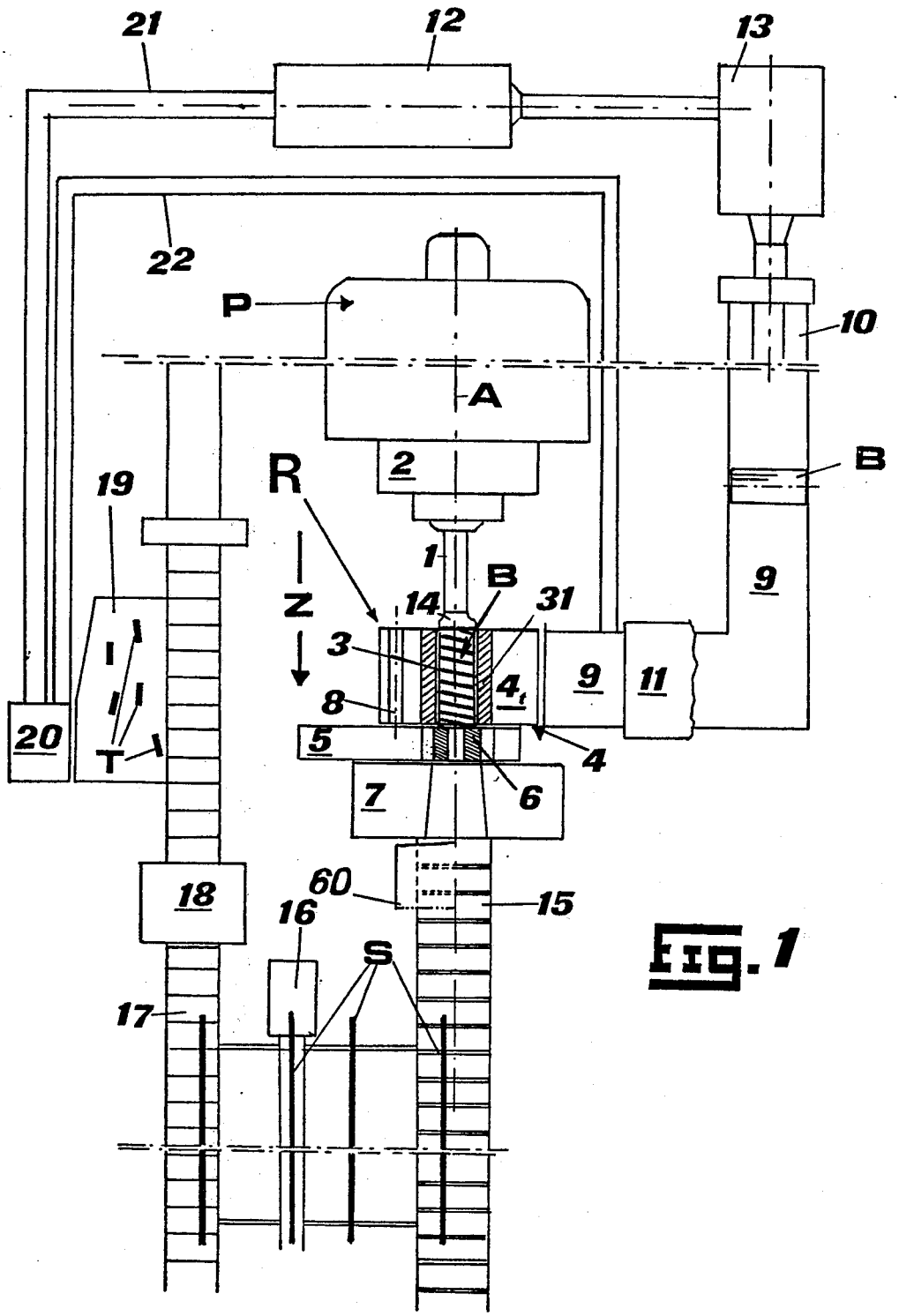
FIG. 1 shows a schematic plan view of equipment for extruding sections with a container.

Equipment for shaping aluminium billets B in an extrusion device R includes in a short stroke press P, a press ram 1 which can be pushed by a main drive 2 of a short stroke press P in a direction of extrusion Z in a passage 3 of a container 4.

At the end of the passage 3 facing away from the press ram 1 there is disposed a die 6 mounted in a die slide 5, which abuts a crosshead 7 of the extrusion device R. Two halves **4*t* and 4*h* of the container 4, which is split horizontally approximately at the level of its center axis A, are hingeably joined through a shaft 8 at the side of the container 4**.

Loading of this container with billets B takes place via a conveyor mechanism 9, which transports the billets B from a series of molds 10 through a chamber 11 to maintain the mold temperature at a predetermined level and then to the extrusion press R itself. This chamber 11 can be heated by waste gas to save energy.

The series of molds 10 are disposed downstream of a remelting furnace 12 with a teeming ladle, or a temperature holding furnace 13.

After loading the container with a billet B, the press ram 1 fitted with a dummy block 14 moves in the direction of extrusion Z through the passage 3, and the die, thus producing extrusion profiles S, which are discharged through the crosshead 7 onto a discharge 15.

The sections S are then moved to a stretcher 16 disposed at the side of the discharge table 15 and therefrom to a further conveyor 17, the conveyor 17 moving them to a sawing unit 18.

Scrap pieces T slide down a chute 19 to a baling press 20; bundles of the scrap pieces are then fed via a transport mechanism 21 to the remelting furnace 12.

A transport system 22 conveys the non-illustrated bale of scrap from the baling press 20 immediately to the container 4, into which it can be loaded even without preheating.

Figure 2:
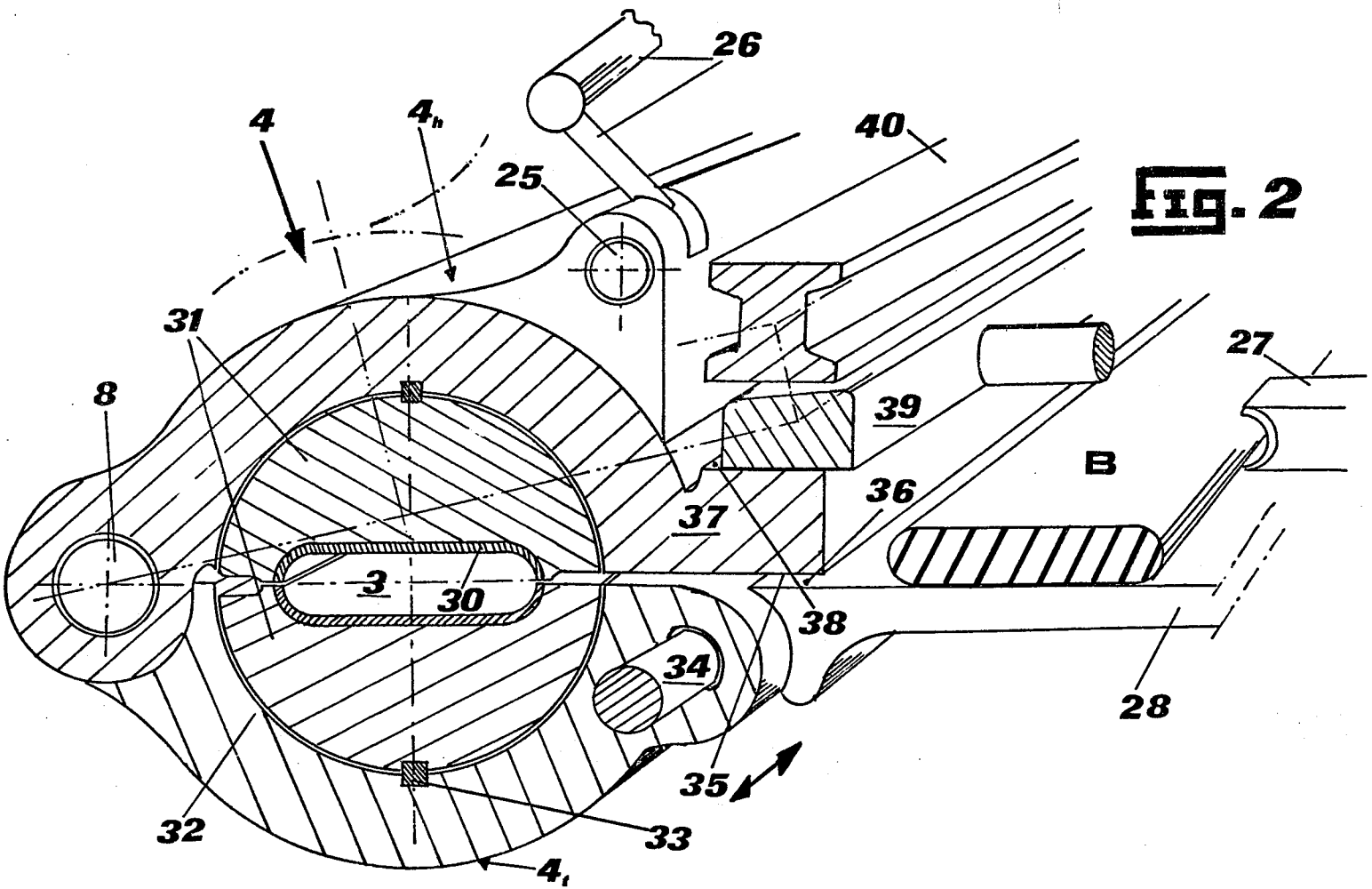
FIG. 2 shows the container with one passage shown in FIG. 1 but enlarged and sectioned.
Figure 3:
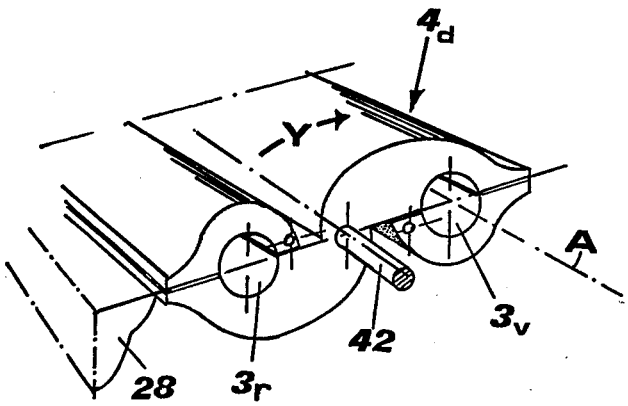
FIG. 3 shows a perspective view of a container with two passages.

The upper part **4*h* of the split container 4, shown in FIG. 2, can, be tilted from its operating position about the shaft 8 into an open position, indicated by broken lines, by means bell crank 26, which is connected through a hinge 25 to the upper part 4*h* thus allowing loading of a new billet B, which is introduced by a slide feed 27 disposed above a table 28. The billet B and the passage 3 have an elongated cross section but may in an alternate version, have a round or differently shaped cross section. It is also possible to place, cross sectional shapes of different kinds side-by-side. The passage 3 is defined by two facing members 30 which are fastened by wedges 33 to liners 31 and to a housing 32 of the container parts 4*t* and 4*h*. The facing member 30 and the liners 31 of the upper part 4*h* of the container can then be tilted about the eccentrically placed shaft 8, as best seen in FIG. 2. The shaft 8 serves to control the closing force of the container and is connected to a non-illustrated sliding cylinder of the container 4**.

On a side of the container 4 opposite to the shaft 8, there is provided a rod 34 which additionally aids in closing the container 4. When the billet B is placed in the passage 3, the upper part **4*h* is returned into place by the bell crank 26, and the surface 35 of the container opening is pressed against the corresponding face 36 of the lower part 4*t*. The surface 35 forms a part of a radial projection 37, on a surface 38 of which there is pressed a wedge 39 by means of a beam-like rail 40 for applying closing pressure in place of, or in addition to the bell crank 26**. Because of the sloping contact area of the wedge, the closing pressure can be increased or reduced, as desired.

Figure 4:
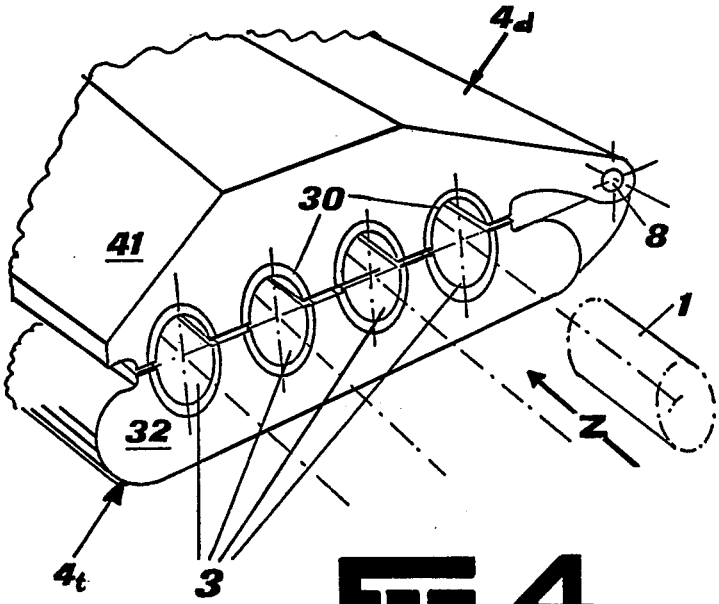
FIG. 4 shows a perspetive view of a container with four extrusion passages.

A split container $4_d$ shown in FIG. 4 has first and second passages $3_r$ and $3_y$; the corresponding container portions can be rotated about a shaft 42; while the channel $3_y$ is disposed in line with the axis A of the extrusion press ram 1, a new billet B can be introduced into the second passage **3*r* and can be rotated together with the container 4*r* around the shaft 42 towards the extrusion stem 1** shown in FIG. 1.

Figure 5:
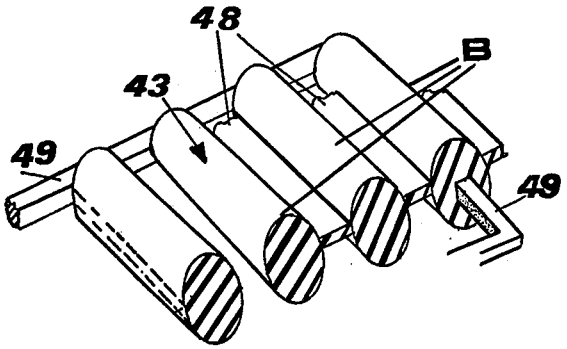
FIG. 5 shows a series of billets which are joined together and are to be introduced into the container shown in FIG. 4.
Figure 6:
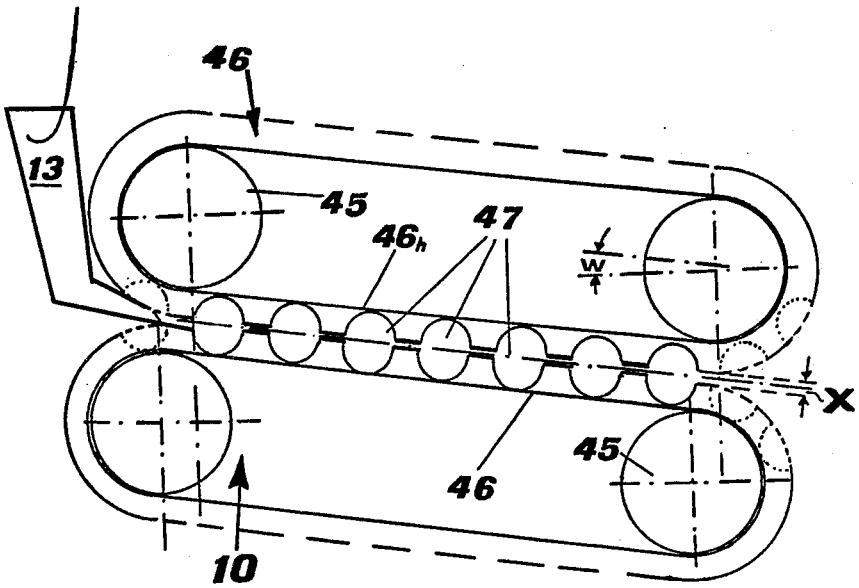
FIG. 6 shows a schematic representation from another detail from FIG. 1, shown here in section.

In accordance with FIG. 5, a split container 4e is provided with a plurality of extension passages each having a press ram (of which only one is illustrated) associated therewith. A plurality of billets 43 joined together by connecting spar 48 are inserted into the split container from one side thereof by gripping means 49. All of the press rams may be driven by the same main drive and, if desired, the extrusion speed of the individual billets 43 can be controlled by operating and controlling each of the press rams individually.

For casting a plurality 43 of billets B the series of molds 10 have two continuous mold belts 46 which move synchronously over rollers 45, subtend an acute angle W with the horizontal, and are formed with a series of grooves 47, which in matching pairs form respective molds 47 for the billets B. In the drawing, only the grooves of the belts in a region where they form the molds are shown for clarity. The variable distance x between the two neighbouring belts of molds $46_l$ and $46_h$ allows a connecting spar 48 to be formed between the billets B, which permits easier loading of the multichannel container 4e but which can also be eliminated without incurring any penalty. Lateral pincer arms 49 may grip a plurality of parallel billets B simultaneously and transport them to the container 4.

I wish it to be understood that I do not desire to be limited to the exact details of construction shown and described, for this modification will occur to persons skilled in the art.

What is claimed is:

1. A machine for extruding billets, in particular aluminum billets, comprising in combination:

a split container having first and second parts and movable between open and closed positions, a central axis, billet-feeding means disposed laterally of said container, the billets being disposed substantially parallel to said central axis, said first part being eccentrically and unyieldingly pivotably hinged to said second part and disposed substantially parallel to said container central axis, one of said parts being stationary, the other of said parts being movable from a loading position to a passage-forming position, the container being in said open position in said loading position, and being substantially in said closed position and formed with an extrusion passage in said passage-forming position, the billets being loadable into said container in the open position by said billet-feeding means, a press ram, passable through said passage, closure means for pressing said first part against said second part for moving said container into said closed position, and further comprising a plurality of molds disposed upstream of said feeding means for molding the billets, a casting furnace disposed upstream of said molds for furnishing molten material to said molds, cutting means disposed downstream of said container for cutting the extruded billets, there being operatively produced billet chips by said cutting means, a baling press cooperating with said sawing means for processing the chips, and conveyor means interconnected between said baling press and said casting furnace for returning the processed chips to said casting furnace.

2. The extrusion equipment according to claim 1 wherein said molds are formed by a pair of synchronously movable cooperating belts.

3. The extrusion machine according to claim 2 wherein said pair of belts is operatively movable in a predetermined direction, and wherein each of said belts is formed with a plurality of grooves having a direction transverse to the belt-moving direction, selected grooves of one of said belts mating with selected grooves of the other of said belts, the mating grooves constituting said molds.

4. The extrusion machine according to claim 2 wherein said belts are spaced from one another at an adjustable distance to permit formation of a connecting means for joining the billets during the molding thereof.

5. The extrusion machine according to claim 1 wherein said container includes at least one facing member movable therewith and at least partly defining said extrusion passage, and at least one lining member removable from said container.

6. The extrusion machine according to claim 1, wherein said closure means includes a bell crank pivotably attached to said first part.

7. The extrusion machine according to claim 1, wherein said closure means includes a hydraulic cylinder pivotably attached to said first part.

8. A machine for extruding billets, in particular aluminum billets, comprising in combination:

a split container having first and second parts and movable between open and closed positions, a central axis, billet-feeding means disposed laterally of said container, the billets being disposed substantially parallel to said central axis, said first part being eccentrically and unyieldingly pivotably hinged to said second part and disposed substantially parallel to said container central axis, one of said parts being stationary, the other of said parts being movable from a loading position to a passage-forming position, the container being in said open position in said loading position, and being substantially in said closed position and formed with an extrusion passage in said passage-forming position, the billets being loadable into said container in the open position by said billet-feeding means, a press ram, passable through said passage, and closure means for pressing said first part against said second part for moving said container into said closed position wherein said closure means includes movable wedge means insertable between said first part and a support means for said extrusion machine.

9. The extrusion machine according to claim 8 wherein said split container has an entry region and said first part includes a support element radially projecting from the container entry region, said wedge means being insertable between said support element and the support means.

10. The extrusion machine according to claim 9 further comprising said support means, said support means including a rail-like carrier.

11. A machine for extruding billets, in particular aluminum billets, comprising in combination:

a split container having first and second parts and movable between open and closed positions, a central axis, billet-feeding means disposed laterally of said container, the billets being disposed substantially parallel to said central axis, said first part being eccentrically and unyieldingly pivotably hinged to said second part and disposed substantially parallel to said container central axis, one of said parts being stationary, the other of said parts being movable from a loading position to a passage-forming position, the container being in said open position in said loading position, and being substantially in said closed position and formed with an extrusion passage in said passage-forming position, the billets being loadable into said container in the open position by said billet-feeding means, a press ram, passable through said passage, closure means for pressing said first part against said second part for moving said container into said closed position, and wherein said container includes at least a second passage and a second press ram, each of said rams being controllable individually.

12. The extrusion machine according to claim 11 further comprising gripping means for gripping and simultaneously transporting a plurality of billets aligned substantially parallel to one another.

13. A machine for extruding billets, in particular aluminum billets, comprising in combination:

a split container having first and second parts and movable between open and closed positions, a central axis, billet-feeding means disposed laterally of said container, the billets being disposed substantially parallel to said central axis, said first part being eccentrically and unyieldingly pivotably hinged to said second part and disposed substantially parallel to said container central axis, one of said parts being stationary, the other of said parts being movable from a loading position to a passage-forming position, the container being in said open position in said loading position, and being substantially in said closed position and formed with an extrusion passage in said passage-forming position, the billets being loadable into said container in the open position by said billet-feeding means, a press ram, passable through said passage, closure means for pressing said first part against said second part for moving said container into said closed position, and wherein said container is formed with a second passage, has third and fourth parts, and is rotatable around an axis of rotation disposed between said passages, said first and second parts, on one hand, and said third and fourth parts, on the other hand, defining the first and second passages, respectively, said first and third parts being at least partly separable from said second and fourth parts, respectively.

14. A machine for extruding billets, in particular aluminum billets, comprising in combination:

a split container having first and second parts and movable between open and closed positions, a central axis, billet-feeding means disposed laterally of said container, the billets being disposed substantially parallel to said central axis, said first part being eccentrically and unyieldingly pivotably hinged to said second part and disposed substantially parallel to said container central axis, one of said parts being stationary, the other of said parts being movable from a loading position to a passage-forming position, the container being in said open position in said loading position, and being substantially in said closed position and formed with an extrusion passage in said passage-forming position, the billets being loadable into said container in the open position by said billet-feeding means, a press ram, passable through said passage, closure means for pressing said first part against said second part for moving said container into said closed position, and further comprising a bearing for said container to be slidable therethrough in an axial direction.

* * * * *